United States Patent [19]

Nielsen

[11] Patent Number: 4,738,471

[45] Date of Patent: Apr. 19, 1988

[54] METHOD FOR CHECKING THE INTEGRITY OF A SERIES OF PRINTED SHEETS

[76] Inventor: Allan Nielsen, 14 Aquire Avenue, Winnipeg, Manitoba, Canada, R2Y 0B8

[21] Appl. No.: 31,586

[22] Filed: Mar. 30, 1987

[51] Int. Cl.[4] ..... B42D 15/00

[52] U.S. Cl. ..... 283/67; 283/39; 283/42

[58] Field of Search ..... 281/38, 1, 15 R; 283/1 R, 36, 37, 38, 39, 40, 41, 42, 67, 61, 81

[56] References Cited

U.S. PATENT DOCUMENTS

| | | | |
|---|---|---|---|
| 4,300,791 | 11/1981 | Bohrer et al. | 283/42 X |
| 4,355,824 | 10/1982 | Weber et al. | 283/81 |
| 4,445,711 | 5/1984 | Cunningham | 283/39 X |
| 4,585,253 | 4/1986 | Beisswanger | 283/39 |

*Primary Examiner*—Paul A. Bell

*Attorney, Agent, or Firm*—Stanley G. Ade; Adrian D. Battison; Murray E. Thrift

[57] ABSTRACT

A method for checking the integrity of a series of printed sheets of the type in which a consecutive series of codes is printed on the sheets is provided which reduces significantly the time necessary for checking after collation of the sheets and significantly reduces the possibility of error in collation. The method includes printing on an extreme edge of each of the sheets a mark which is positioned on the edge in dependence upon the code printed on the sheet. Thus when the sheets are collated and fanned so that the extreme edges are exposed, the marks can be observed in a stairstep pattern so that any omitted marks or improperly positioned marks can readily be observed indicating an incorrect positioning of a sheet or the omission or addition of sheets.

15 Claims, 3 Drawing Sheets

METHOD FOR CHECKING THE INTEGRITY OF A SERIES OF PRINTED SHEETS

BACKGROUND

This invention relates to a method of checking the integrity of a series of printed sheets in which each of the sheets carries one of a series of consecutive codes preferably alpha or digit codes.

Many filing systems now in use of the type often used in hospitals, courts of law, insurance companies and the like include file folders which have labels applied to an edge of the file folder in a numerical and color code sequence. Thus for example a purchaser may require 100,000 numerical labels from 00,000 to 99,999 reading from top to bottom in vertically positioned numbers. In many cases each number 0 to 9 is associated with a particular color so that a user visually scanning an open filing system can readily observe misfiling of a particular file since it does not follow the color patterns which will be apparent from the filing system.

In order to produce these labels it is necessary to print onto a series of sheets of card or paper the proper numerical sequences.

Thus the first sheet would normally have printed on a lowermost row of the sheet the numeral 00 to 09 printed in a color associated with the numeral 0. A second sheet will have in the lowermost row the numerals 10 to 19 printed in the color associated with the numeral 1. Third and subsequence sheets will of course have the subsequent numerals in the sequence associated with the respective number.

Subsequently it is necessary to print onto each of the ten sheets in a series the number in the next column from the bottom of the sheet which will be one of the series 0 to 9 in the respective color.

In the example in which 100,000 labels are required, each of the ten different sheets of the first row will be printed one thousand times and then these must be collated into the required sets of ten consecutive numbers for printing of the next numeral of the row above. Subsequently further collation must be carried out in order to print the numeral of the third row in a similar manner to the numeral of the second row.

It is extremely important in all of the collations and reprintings that there are no errors in the collation since otherwise the proper numerical sequence from 00,000 to 99,999 will be lost thus destroying the integrity of the filing system with the danger of files being lost and misplaced since the proper color coded pattern cannot be followed.

The printing of the required sheets for the subsequent cutting into separate labels and application to the file folders has therefore to date required careful manual editing of the sheets after collation to ensure that the proper numerical sequence is followed. This is of course a very tedious and lengthly task which is expensive in labor costs and is prone to error in view of the tediousness involved. In some examples up to one million numerically coded files are printed in one run and the task of manually checking each sheet is of course a horrendous undertaking.

SUMMARY OF THE INVENTION

It is one object of the present invention, therefore, to provide a method of checking the integrity of a series of printed sheets which can be carried out rapidly and simply and at little or no added expense in the printing process.

Accordingly to the invention, therefore, there is provided a method of determining the integrity of a series of printed sheets in which the series comprises consecutive symbols with each symbol printed on a one surface of a respective one of the sheets, the method comprising printing said symbols on each said sheet in turn and simultaneously printing on said one surface so as to intersect an extreme edge of each sheet in turn of the series a mark which is visible when the sheets are fanned to expose said extreme edge of the sheets, and selecting the positioning of the mark longitudinally of the edge of each sheet in dependence upon the symbol of the series printed on that sheet.

According to a second aspect of the invention there is provided a method of creating an integral series of printed sheets in which the series comprises consecutive alpha or digit codes, the method comprising printing onto each of a plurality of sets of sheets a respective one of said codes such that each sheet of a set has printed thereon a respective one of the codes, simultaneously with said printing of said codes printing at an extreme edge of each sheet a mark which is visible when the sheets are fanned to expose said extreme edges of the sheets, selecting the position of the mark at the edge of each sheet longitudinally thereof in dependence upon the code printed on that sheet, collating the sheets to form a plurality of sets of collated sheets with each set having the sheets arranged consecutively, checking the integrity of the sets by fanning the sheets to expose said extreme edges thereof and by inspecting the integrity of the series of marks positioned in dependence upon the codes, and printing on each set a further code.

According to a third aspect of the invention there is provided a series of printed sheets each having printed thereon a respective one of a plurality of consecutive alpha or digit codes, said sheets being collated such that the sheets follow in the consecutive series, each sheet having printed thereon at an extreme edge thereof a mark which is visible when the sheets are fanned to expose said extreme edges of the sheets, the position of the mark at the edge longitudinally of the respective sheet being dependent upon the code printed on the respective sheet.

The marks therefore at the edge of the sheet can be used when the sheets are collated into the consecutive series for the series to be rapidly scanned simply by observing the fanned overlying edges of the sheet. Preferably therefore the marks are arranged side by side with each consecutive code or number having associated therewith the next adjacent mark in a series of the marks. Thus the marks can be observed in a stair-step configuration and any mark which is out of position or missing will indicate that the sheet is out of its proper collated position. As the marks are applied to the front face of the sheet immediately at the extreme edge, they are readily visible in the fanned condition and also can be readily severed or cut from the sheet when the checking is complete.

Preferably a series of the codes is printed along the edge adjacent the edge so that when the marks associated with each code are applied to the edge they lie along side an indication of the respective code.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
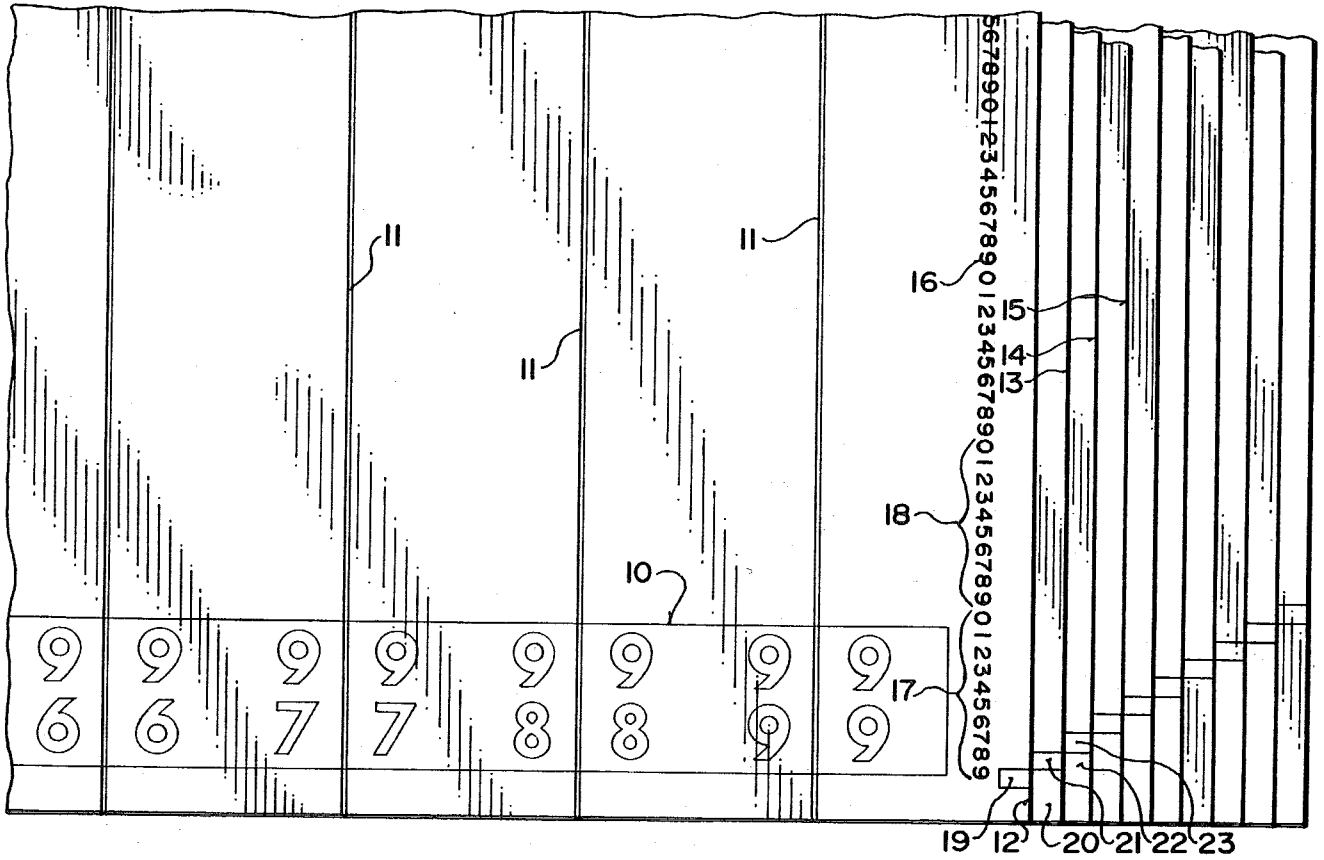
FIG. 1 is a top plan view of a series of sheets with the extreme edges thereof fanned to show the checking marks.
Figure 2:
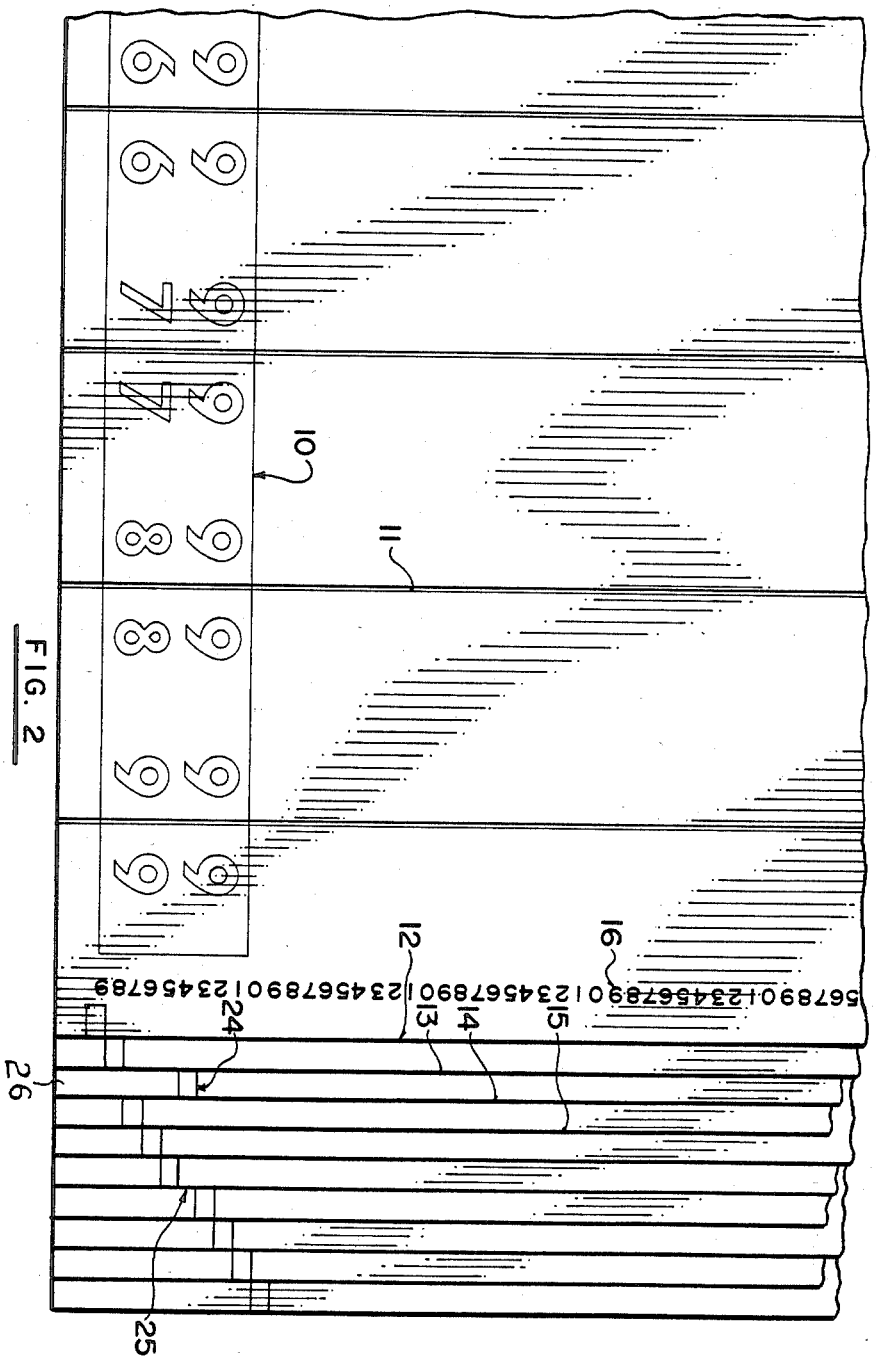
FIG. 2 is a top plan view similar to that of FIG. 1 showing the same fanned series of sheets as that of FIG. 1 but with one of the sheets misplaced in its collated series.

In FIGS. 1 and 2, the first row has been printed onto a plurality of sheets. The remaining rows of numbers from the lowermost row printed through to an uppermost row remain yet to be printed. The first row is indicated at 10 and in the example shown, only part of which is visible, sheet includes the numerals 90 through 99 with each of the numerals being printed twice on either side of a crease line 11 indented in the sheet.

The extreme righthand edge of the sheet is indicated at 12 with the extreme righthand edges of further sheets being indicated at 13, 14, 15 et seq. Adjacent the righthand edge of each of the sheets is provided a row 16 of the same codes as appear in the bottom row 10. Thus the codes 0 to 9 are provided adjacent the lowermost row and covering a longitudinal extent of the edge 12 substantially equal to the height of the row 10. Each further row (not yet printed) is associated with a further set of the codes 0 through 9 one of which is indicated at 18.

The uppermost sheet includes a mark 19 printed simultaneously with the column of printing 10 and printed in the same color. The mark 19 is positioned adjacent the code 9 of the column of codes 17. Thus the mark 19 is associated with the codes 9 of the column 10. The next underlying sheet indicated at 20 includes a mark 21 which, it will be noted, lies along side the code 8 of the column 17. Thus the next underlying sheet 20 includes in the printed column at the lowermost position the codes 80 through 89 printed similarly to the codes of the column 10. Similarly the next underlying sheet 22 includes a mark 23 which is adjacent the code 7 of the column 17.

In FIG. 1 the sheets have been properly collated so that the marks 19, 21, 23 et seq. define a proper stairstep configuration which indicates that the collation is proper and complete.

In FIG. 2 the same sheets have been collated but in this case the collation is improper and an error has been made. This error is clearly apparent by the mark indicated at 24 which is out of its proper position in the stair-step configuration. Furthermore it is clear that a mark is omitted at the point indicated at 25 since again the proper stairstep configuration is not followed. In this case the error consists simply in a transposition of the sheet indicated at 26. In other cases the sheet may be omitted altogether in which case this will be observed by the configuration of the type illustrated at 25. In other cases additional sheets may be included which would be indicated by an improperly placed mark of the type indicated at 24.

In the formation of the sheets up to the stage illustrated in FIGS. 1 and 2, in the previously described example where 100,000 collated sheets are required numbering from 00,000 to 99,999, one thousand of the uppermost sheets are printed in a first step following which one thousand of each of the underlying sheets 20, 22 et seq. are printed. At the completion of that stage therefore there is provided ten sets of sheets each set including one thousand such sheets and each set being different from the other by virtue of the codes included in the lowermost column.

At this stage the sheets must be collated into one thousand sets each of ten consecutive sheets of the type shown in FIGS. 1 and 2. This collation is carried out by machine which grabs and sorts the sheets into the required collated sets. The machine is generally accurate in its operation but occasionally errors are obtained if for example the pick up mechanism misses a particular sheet or picks up two such sheets.

Following collation, the checking as previously described is carried out by fanning the sheets of the collated set to observe the marks at the extreme right-hand edge of each of the sheets. The one thousand collated sets can then be passed to a next stage of printing for printing the next adjacent column above the column 10. It will be appreciated that the printing of the next column will again generate 10 different sets each using one of the numbers 0 to 9 in the column above the first column 10. One hundred of each of these sets will be necessary and collation again carried out for printing of the third column from the bottom and subsequently the fourth column from the bottom after yet further collation and checking.

Figure 3:
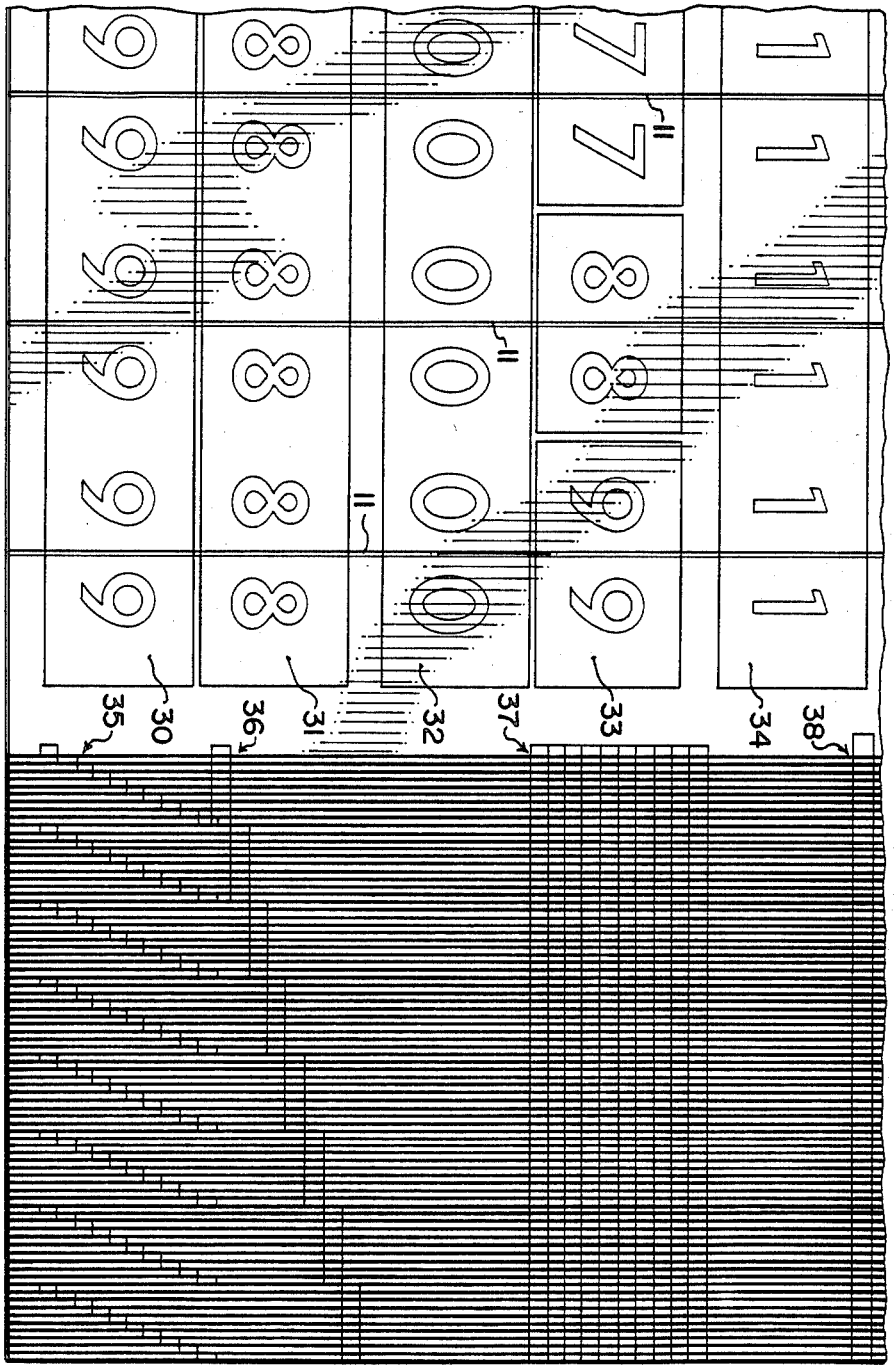
FIG. 3 is a similar top plan view of a larger number of sheets which have been collated into more than one series and showing the extreme edges fanned to indicate the proper collation of those series.

A further example is shown in FIG. 3. In this example the lowermost column indicated at 30 includes only a single digit. The further columns above the lowermost column are indicated respectively at 31, 32, 33 and 34. Each sheet of each column is associated with a respective mark printed on the extreme righthand edge of the sheet as previously described. It will be noted therefore that the first set of marks indicated generally at 35 associated with the lowermost column 30 form a stair-step pattern with each sheet having the next adjacent mark at the next adjacent position. The marks generally indicated at 36 associated with the column 31 again appear in a stair-step design but in this case there are ten such sheets in underlying configuration in each set before the next position of the marks is reached.

In the fourth column 33, a different configuration is used since it will be appreciated that the uppermost sheet which is visible has on it each of the numbers 0 through 9. The marks generally indicated at 37 associated with the column 33 therefore include on each sheet each mark associated with a respective one of the codes 0 through 9. Each of the sheets of the set shown, therefore, has on its extreme righthand edge each of the marks. If an error had been incurred in this column by omitting the printing of one of the sheets for one of the codes, this would appear as a blank space in the otherwise continuous bar of overlying marks.

The uppermost column 34 is associated with a series of marks generally indicated at 38 but in this case the whole of the series includes only one particular code in this case the code "1" and hence the mark associated with code "1" appears as a continuous bar of marks.

Any sheet which has been missed in its printing process will again appear as a blank space in the otherwise continuous bar. An error in collation where for example a sheet having code "2" in the upper column would appear as an erroneous mark in the otherwise continuous column of the marks 38.

The examples shown above relate to numerical or digit codes but of course it will be appreciated that the same technique can be applied to alpha codes or to other consecutive symbols. In addition while the technique has been described wholly in relation to labels for file folders, it can be used for other sheets which have printed thereon consecutive codes of a similar nature.

Subsequent to completion of the label sheets shown in FIGS. 1 through 3, the labels are cut for use on separate file folders and it will be noted that each label is constituted by two columns of identical numbers spaced either side of a fold line. Each double column is therefore cut from the remainder and wrapped around the edge of a file folder and bonded into place. After collation and checking procedures according to the invention, effectively error free series can be generated so that the whole series of file folders is entirely consecutive and fully complete. In the cutting technique, it will be appreciated that the marks at the edge of the sheet become redundant and can be simply cut from the sheet during the cutting process for the individual labels.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of determining the integrity of a series of printed sheets, each sheet having one surface thereof printed with plural columns of symbols from a predetermined sequence of symbols, said method comprising:

(a) printing a column of symbols on said one surface of each sheet;

simultaneously with the printing of the symbols, printing one or more marks representing the symbols in the column on said one surface so as to intersect an extreme edge of the respective sheet, the position of marks along the extreme edge representing both the column in which the represented symbols appear and the position of the represented symbols in the predetermined sequence of symbols;

(c) arranging the sheets in a selected sequence for subsequent printing;

(d) fanning the sheets to expose the extreme edges of the sheets adjacent one another;

(e) correcting the sequence of the sheets as necessary to present a predetermined pattern of said marks; and (f) repeating steps (a) to (e) for each subsequent column of symbols.

2. A method according to claim 1 comprising, for each sheet, printing marks representing the symbols in each column of symbols along a selected zone of said extreme edge.

3. A method according to claim 2 wherein each said selected zone of said extreme edge comprises a sequence of mark sites spaced along said extreme edge, the method further comprising printing each of said marks at the mark sites appearing in the sequence of mark sites at the same position as the symbols represented by the marks appear in the predetermined sequence of symbols.

4. A method according to claim 3 further comprising printing on each said sheet, adjacent said extreme edge, within each said selected zone, a row of said symbols in said predetermined sequence, whereby the mark sites are designated.

5. A method according to claim 1 including printing said symbols in different colours and printing said marks in the same colours as the symbols represented thereby.

6. A method according to claim 1 comprising the additional step of removing the extreme edge of each sheet, and the marks printed therealong.

7. A series of printed sheets, each having one surface thereof printed with plural columns of symbols from a predetermined sequence of symbols, and each sheet having printed thereon one or more marks representing the symbols in each column, the marks being printed along an extreme edge of the sheet, with the positions of the marks representing both the columns in which the represented symbols appear and the positions of those symbols in the predetermined sequence of symbols, whereby by fanning the sheets to expose the extreme edges adjacent one another, the sequence of the sheets can be determined by the pattern of said marks.

8. A series of printed sheets according to claim 7 wherein the marks representing symbols appearing in the respective columns are located in respective zones of said extreme edge.

9. A series of sheets according to claim 8 wherein each said zone of said extreme edge includes a sequence of mark sites spaced along the extreme edge, the marks appearing in the sequence of mark sites at the same position as the symbols represented by the marks appear in the predetermined sequence of symbols.

10. A series of sheets according to claim 9 wherein each sheet comprises a row of said symbols printed in said predetermined sequence adjacent said extreme edge within each said zone, each symbol designating an associated mark site.

11. A series of sheets according to claim 7 wherein the symbols are printed in different colours and the marks are printed in the same colours as the symbols represented.

12. A series of sheets according to claim 7 wherein each mark is a solid rectangle.

13. A series of sheets according to claim 7 wherein the symbols are numerals and said predetermined sequence is in numerical order.

14. A series of sheets according to claim 7 wherein the symbols are letters and said predetermined sequence is in alphabetical order.

15. A series of sheets according to claim 7 wherein said sheets are sheets of file folder labels, each label comprising one or more rows of symbols, and each row including a symbol from each column.

* * * * *